US005628417A

United States Patent [19]

Van Halteren

[11] Patent Number: 5,628,417

[45] Date of Patent: May 13, 1997

[54] MULTI-START BLOW MOLDED LOCKING BOTTLES

[76] Inventor: Jacob Van Halteren, 90 Center Street East, Richmond Hill, Ontario, Canada, L4C 1A4

[21] Appl. No.: 428,303

[22] Filed: Apr. 25, 1995

[30] Foreign Application Priority Data

May 3, 1994 [CA] Canada ..... 2122802

[51] Int. Cl.[6] ..... B65D 41/04

[52] U.S. Cl. ..... 215/44; 215/45; 215/331; 215/356; 220/296

[58] Field of Search ..... 220/288, 296; 215/329, 330, 331, 43, 44, 45, 214, 228, 356, 357; 425/525

[56] References Cited

U.S. PATENT DOCUMENTS

| | | | |
|---|---|---|---|
| 2,056,947 | 10/1936 | Baechle | 220/296 X |
| 2,505,641 | 4/1950 | Howe | 220/296 |
| 3,140,007 | 7/1964 | Nettleship | 215/356 X |
| 3,189,072 | 6/1965 | Starr | 220/288 X |
| 3,276,617 | 10/1966 | Rempt | 220/296 |
| 3,335,923 | 8/1967 | Healy | 220/288 X |
| 3,893,583 | 7/1975 | McLaren | 215/329 X |
| 4,093,096 | 6/1978 | Augros | 215/330 |
| 4,140,235 | 2/1979 | Rausing et al. | 215/356 X |
| 4,252,256 | 2/1981 | Walsh | 215/44 X |
| 4,387,822 | 6/1983 | Lynn | 215/330 |
| 4,640,855 | 2/1987 | St. Clair | 215/356 X |
| 4,755,342 | 7/1988 | Biermann | 425/525 |
| 4,756,857 | 7/1988 | Dezio et al. | 215/44 X |
| 4,836,396 | 6/1989 | Ancona et al. | 215/228 X |
| 5,105,768 | 4/1992 | Johnson | 215/228 X |
| 5,135,124 | 8/1992 | Wobser | 220/296 X |

FOREIGN PATENT DOCUMENTS

| | | | |
|---|---|---|---|
| 2086062 | 5/1994 | Canada . | |
| 216921 | 8/1961 | Germany | 215/356 |

*Primary Examiner*—Allan N. Shoap
*Assistant Examiner*—Nathan Newhouse
*Attorney, Agent, or Firm*—Sterne, Kessler, Goldstein & Fox P.L.L.C.

[57] ABSTRACT

A blow molded plastic cap is provided, having multi-start external threads, the bottom rim of its body being engagable with multiple internal threads of a blow molded plastic container to effect a seal therewith. The interlocking of the threads compresses together the cap and the container forming a seal therewith provided by the side wall and the top wall of the cap in combination with the side wall and the top flange of the container.

17 Claims, 1 Drawing Sheet

MULTI-START BLOW MOLDED LOCKING BOTTLES

The present invention relates to plastic containers particular to one piece blow molded plastic containers having a leak resistant seal.

BACKGROUND OF INVENTION

In the past various types of plastic screw closing mechanism having multiple sealing threads have been proposed and produced. Some types of screw caps proposed have deformable depending skirts of flanges. For the most part past prior art caps have not only involved complicated and expensive mold forms but also required the use of a substantial amount of plastic material in order to effect the desired sealing fit.

In many instances, the configuration of the cap did not insure the preservation of the seals and thereby did not provide leak proof qualities.

Accordingly, there is a need for simple, easily manufactured, inexpensive, but durable blow molded container which has leak proof closure facilities.

SUMMARY OF INVENTION

The object of the present invention is to provide an improved multi-start locking container.

In accordance with one aspect of the present invention there is provided a multi-start blow molded plastic screw cap for use with a threaded neck container, said combination comprising: (a) a blow molded plastic cap body having an annular side wall, said side wall having inclined external threads adapted for engagement with cooperatively inclined internal threads of the container neck; (b) a cap top wall disposed above the side wall having a sealing surface extending around its periphery radially outwardly of said side wall, said top wall being compressibly engagable with top flange of the container neck providing a seal therewith; (c) said cap inclined external threads being cooperatively engagable with the inclined internal threads of the container neck thereby providing engagement and affecting simultaneous seals therewith; whereby said multi-start cap and container lock into position providing for a liquid tight combination.

The present invention therefore provides a blow molded plastic bottle combination obviating the above referenced disadvantages. In accordance with the invention, an improved blow molded plastic cap and container is provided.

The invention provides a cap body having an annular side wall which is integral of a transverse top wall. The side wall has multi-start external threads adapted for engagement with the internal threads of the container neck. There is a sealing surface disposed above the external threads of the side wall of the cap and below the top wall of the same cap. That sealing surface is slidingly engagable with the inner annular surface of the container neck at the top rim thereof. Abutting engagement of the multi-start threads of the cap with the inner rounded annular surface of the container neck provides a first fastening action of the cap to the container.

The sealing surface of the top wall of the cap which is preferably angled but may also be horizontal provides the required seal with the container when compressibly engaged with the container rim. The multi-start threads of the cap are spaced apart a distance equal to the spacing of the cooperating surfaces of the container neck affecting simultaneous seals therewith.

Projecting from the side wall of the cap at the rotationally inner end of at least one thread there may be provided at least one stop member to prevent over rotating of the cap by abutting against the inner thread of the container neck. Provision of such a stop member permits the use of fairly thin and inexpensive plastic material in the area of the threads. It will be appreciated that threads are typically molded from relatively thicker material, to avoid deformation upon tightening, and thus having the threads skip. By providing a stop member at the end of at last one thread, over-rotation is substantially avoided, so deformation is also avoided. Moreover, by providing a multi-start thread, precise axial position of the cap for affecting its sealing fit is not necessary.

BRIEF DESCRIPTION OF THE DRAWINGS

The present invention will be further understood from the following description With reference to the drawings in which.

DETAILED DESCRIPTION OF THE DRAWINGS

Figure 1:
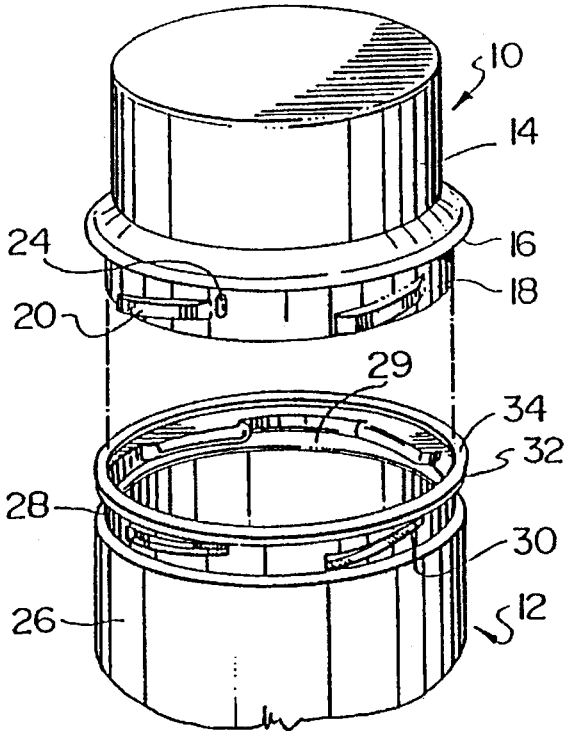
FIG. 1 is a perspective view showing the cap in axial relation to the container.

Referring to FIG. 1, there is illustrated a multi-start thread, closable blow molded bottle. As shown the cap of the bottle of the invention is designated broadly by numeral 10 being adapted for use with a container 12.

The cap 10 has a body portion 14, a top wall 16 which is angled towards its radially inner edge and an annular side wall 18 which is provided with inclined non-overlapping external threads 20 and the angle of which varies between 1–15 degrees but being preferably about 4 degrees. Top wall 16 includes sealing surface 40 extending around its periphery substantially radially outwardly of annular side wall 18 and a top surface 42 spaced apart from sealing surface 40. A stop member 24 at the rotational inward end of one thread is also provided for stopping the cap from over rotating when attached to the container 12.

Figure 3:
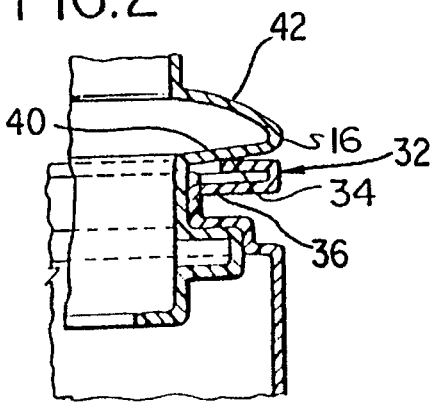
FIG. 3 is a cross section along line 3—3 showing the threads in co-operable position.

The container 12 has a body portion 26 and a neck portion 28 the tubulure of which is provided with inclined non-overlapping internal thread 30, the angle of which is cooperatively equal to the angle given to the external threads 20 of the cap 10. The neck portion 28 forms a portion of an exterior of container 12. Connected to the neck portion 28 is a flange 32. Flange 32 has a bottom edge 36 extending radially outwardly from neck portion 28 and a top edge 34, attached to bottom edge 36, and extending radially inwardly therefrom. As shown in FIG. 3, flange 32 comprises a substantially U-shape whereby top edge 34 and bottom edge 36 are spaced apart from each other causing flange 32 to be flexible. Flange 32 provides a smooth sealing surface located at the top edge 34. The neck portion 28 is also rounded off on the inside section 29 of the container. In accordance with the present invention the flange 32 and the top edge 34 of the container 12 are intended to cooperate with mating surfaces of the cap 10 to effect a reliable liquid tight seal.

In accordance with the invention, the diameter of the side wall 18 of the cap 10 is smaller than the diameter of the tubulure of the container neck 28 to allow for inserting of the cap 10 onto the container.

The eternal threads 20 of the cap 10 serve as guides when inserting into the container 12 cup 10 and are engaged with the rounded off inside section 29 of the container neck 28 in a plug fit fashion bringing the sealing surface 40 of top wall 16 and the top edge 34 of flange 32 in contact. The fact that the edges of the external threads 20 and of the internal threads 30 are smoothed out makes for a much easier fitting of the cap 10 and container 12.

Figure 2:
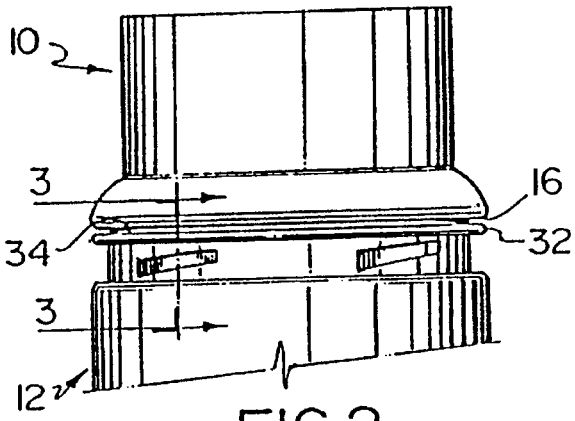
FIG. 2 is a front view showing the cap and the container in a locked position.

The next step shown in FIG. 2 consists in twisting the cap 10 to engage the external threads 20 of the cap 10 and the internal threads 30 of the container 12 fastening the two pieces together and bringing the top wall 16 and the top edge 34 of the flange 32 in closer relationship by compressing together these two surfaces therefore creating a seal between them.

FIG. 3 shows cap 10 and container 12 fittingly attached to one another and the mechanism by which the incline given the external threads 20 and the internal threads 30 provides for a liquid tight seal. The seal is provided at the interface between sealing surface 40 of top wall 16 and top edge 34. Sealing surface 40 of top wall 16 seals against top edge 34 around its entire perimeter, and will deflect inward slightly as the cap is tightened onto the container, ensuring a tight seal of the cap to the container. It will be understood, therefore, that any scrap pieces or uneven edges remaining in this area after molding must be neatly trimmed away.

It will be noted that the number of threads used in our multi-start blow molded locking bottle is preferably four external for the cap and an equal number of internal for the container.

While the form of apparatus herein described constitutes a preferred embodiment of the invention, it is to be understood that the invention is not limited to this precise form of apparatus and that changes may be made therein without departing from the scope of the invention.

What is claimed is:

1. A container, comprising:

a multi-start screw cap, including a cap body having an annular side wall, said annular side wall having first inclined screw threads, and a cap top wall disposed above said annular side wall having a sealing surface extending at an angle around its periphery substantially radially outwardly of said annular side wall; and a threaded neck container, including a neck portion having second inclined screw threads, a flange extending from said neck portion, wherein said flange has a bottom edge extending radially outwardly from said neck portion and a top edge, connected to a distal end of said bottom edge, and extending radially inwardly therefrom, wherein said sealing surface of said cap top wall is compressibly engageable with said top edge of said flange causing said flange to compress, providing a seal therewith, wherein said first screw threads are cooperatively engageable with said second screw threads thereby providing engagement and effecting a simultaneous seal therewith, whereby said screw cap and said threaded neck container lock into position providing for a liquid tight seal.

2. A container as in claim 1, wherein an inside diameter of said neck portion of said container is greater than an inside diameter of said annular side wall of said cap.

3. A container as in claim 1, wherein said neck portion of said container includes an inner rounded annular surface providing frictional engagement with said first screw threads.

4. A container as in claim 1, wherein said first inclined screw threads do not overlap each other and said second inclined screw threads do not overlap each other.

5. A container as in claim 1, further comprising:

a stop member provided on said multi-start screw cap to avoid over-rotation of said first and second inclined screw threads.

6. A container as in claim 1, wherein an angle of incline of said first and second inclined screw threads is approximately four degrees.

7. A container as in claim 1, wherein said flange comprises substantially a U-shape.

8. A container as in claim 1, wherein said first inclined screw threads are external screw threads and said second inclined screw threads are internal screw threads.

9. A container as in claim 1, wherein said multi-start screw cap is formed by blow-molding.

10. A container, comprising:

a multi-start screw cap, including a cap body having an annular side wall, said annular side wall having first inclined screw threads, and a cap top wall disposed above said annular side wall having a sealing surface extending around its periphery substantially radially outwardly of said annular side wall;

a threaded neck container, including a neck portion having second inclined screw threads, a flange extending from said neck portion, wherein said flange has a bottom edge extending radially outwardly from said neck portion and a top edge, connected to a distal end of said bottom edge, and extending radially inwardly therefrom, wherein said sealing surface of said cap top wall is compressibly engageable with said top edge of said flange causing said flange to compress, providing a seal therewith;

wherein said first screw threads are cooperatively engageable with said second screw threads thereby providing engagement and effecting a simultaneous seal therewith, whereby said screw cap and said threaded neck container lock into position providing for a liquid tight seal; and a stop member provided on said screw cap to prevent over-rotation of said first and said second screw threads.

11. A container as in claim 10, wherein an inside diameter of said neck portion of said container is greater than an inside diameter of said annular side wall of said cap.

12. A container as in claim 10, wherein said neck portion of said container includes an inner rounded annular surface providing frictional engagement with said first screw threads.

13. A container as in claim 12, wherein said first inclined screw threads are external screw threads and said second inclined screw threads are internal screw threads.

14. A container as in claim 12, wherein said multi-start screw cap is formed by blow-molding.

15. A container as in claim 10, wherein said sealing surface of said cap top wall is disposed at an angle.

16. A container as in claim 10, wherein said first inclined screw threads do not overlap each other and said second inclined screw threads do not overlap each other.

17. A container as in claim 10, wherein an angle of incline of said first and second inclined screw threads is approximately four degrees.

* * * * *